US007132984B2

(12) United States Patent
Kameda et al.

(10) Patent No.: US 7,132,984 B2
(45) Date of Patent: Nov. 7, 2006

(54) ANTENNA WITH BUILT-IN FILTER

(75) Inventors: Shozaburo Kameda, Yokohama (JP); Hiroshi Ichikawa, Ube (JP); JunXiang Ge, Tokyo (JP)

(73) Assignees: Yokowo Co., Ltd, Tokyo (JP); UBE Industries, Ltd., Yamaguchi (JP)

( * ) Notice: Subject to any disclaimer, the term of this patent is extended or adjusted under 35 U.S.C. 154(b) by 0 days.

(21) Appl. No.: 10/520,814

(22) PCT Filed: Jul. 3, 2003

(86) PCT No.: PCT/JP03/08435

§ 371 (c)(1),
(2), (4) Date: Jan. 7, 2005

(87) PCT Pub. No.: WO2004/006384

PCT Pub. Date: Jan. 15, 2004

(65) Prior Publication Data

US 2006/0055601 A1 Mar. 16, 2006

(30) Foreign Application Priority Data

Jul. 5, 2002 (JP) ..... 2002-196684

(51) Int. Cl.
*H01Q 1/38* (2006.01)

(52) U.S. Cl. ..... 343/700 MS; 343/850

(58) Field of Classification Search ..... 343/700 MS, 343/702, 850, 873; 333/134
See application file for complete search history.

(56) References Cited

U.S. PATENT DOCUMENTS 5,898,403 A 4/1999 Saitoh et al. ..... 343/700 MS
6,178,311 B1 1/2001 Pance et al. ..... 455/78
6,456,172 B1 * 9/2002 Ishizaki et al. ..... 333/204
6,542,050 B1 * 4/2003 Arai et al. ..... 333/134
6,762,723 B1 * 7/2004 Nallo et al. ..... 343/700 MS
6,911,942 B1 * 6/2005 Fukuda et al. ..... 343/700 MS
2003/0147197 A1 8/2003 Uriu et al. ..... 333/185
2004/0070538 A1 * 4/2004 Horie et al. ..... 343/700 MS

FOREIGN PATENT DOCUMENTS

JP 09-130103 A 5/1997

(Continued)

OTHER PUBLICATIONS

International Search Report mailed on Aug. 26, 2003.

(Continued)

*Primary Examiner*—Tuyet Vo
*Assistant Examiner*—Ephrem Alemu
(74) *Attorney, Agent, or Firm*—Rader, Fishman & Grauer PLLC

(57) ABSTRACT

A laminated dielectric block (3) is formed by laminating dielectric sheets (31) each having a conductive film formed on its one surface so as to constitute at least one filter (2). A radiation element (1) is provided so as to fix to the laminating dielectric block, wherein one electrode of the filter is electrically connected to the radiation element. The other electrode (22) of the filter is connected to a feeding terminal electrode (4) provided mounting face B (a face opposing to a circuit board) of the laminated dielectric block through a via-contact (33) and a wiring (34), not being exposed to the side face. As a result, an antenna with built-in filter of the structure where even if it is mounted on a circuit board, interference between an electronic circuit on the circuit board and the feeding terminal electrode of the antenna is prevented to improve the isolation characteristic and transmitting or receiving characteristic.

11 Claims, 5 Drawing Sheets

FOREIGN PATENT DOCUMENTS

| | | | |
|---|---|---|---|
| JP | 2000-349680 | A | 12/2000 |
| JP | 2001-094336 | A | 4/2001 |
| WO | WO-01/69710 | A1 | 9/2001 |

OTHER PUBLICATIONS

EPO Search Report mailed on Jul. 13, 2006.

* cited by examiner

ANTENNA WITH BUILT-IN FILTER

This application is the U.S. National Phase of International Aplication PCT/JP03/08435 filed Jul. 3, 2003 which claims priority of JP2002-196684 filed Jul. 5, 2002.

TECHNICAL FIELD

The present invention relates to an antenna with built-in filter that is compact, easy to get a match and suitable to be mounted to a cellular phone or portable terminal device and has a configuration of not being interfered with an electronic circuit on a circuit board when it is mounted on the circuit board. More specifically, the invention relates to an antenna with built-in filter having a configuration of preventing that, even in the case where it is used in plural frequency bands such as for a cellular phone and for a GPS or Bluetooth, for example, the other signal inputs into a receiving circuit side via a feeding terminal electrode to be interfered with each other.

BACKGROUND ART

An antenna is conventionally configured to be capable of receiving or transmitting only a signal of a desired frequency band via a filter such as a band pass filter. Conventionally, the filter individually manufactured has been externally connected to an antenna for use. Recently, an antenna with built-in filter wherein an antenna and a filter are integrated has been developed for eliminating a troublesome work of matching an antenna and a filter or for meeting a demand of downsizing an electronic device.

As shown by a partially perspective explanatory view and its sectional explanatory view of FIGS. 7A and 7B illustrating one example of a state where an antenna with built-in filter 85 is mounted on a circuit board 86, the antenna with built-in filter 85 as described above has a laminated dielectric block 83 obtained by laminating dielectric sheets having a conductive pattern formed thereon for forming a capacitor or inductor that composes a filter and by sintering the resultant. A radiation element 81 is formed on the front face of the laminated dielectric block 83. One electrode of the filter is electrically connected to the radiation element 81, while the other electrode is connected to a feeding terminal electrode 84 provided at the outer face of the laminated dielectric block 83 so as to be able to be connected to a transmit-receive circuit that is an external circuit.

As shown in FIG. 7B in which the sectional explanatory view of FIG. 7A is illustrated, in the conventional antenna with built-in filter of this type, a wiring film 834 is extended to an end section to be drawn out from the other electrode of the filter 82 made of a conductive pattern on which an inductor or capacitor is formed, and after forming the laminated dielectric block 83, the feeding terminal electrode 84 is connected to the wiring film 834 exposed to its side face, whereby the feeding terminal electrode 84 is formed so as to go up to the back face (mounting face of the circuit board 86) from its side face. This feeding terminal electrode 84 is directly connected to a feeder 862 of the circuit board 86 by a soldering.

As described above, in the conventional antenna with built-in filter, the other electrode of the filter is drawn to the side face of the dielectric block 83 and the feeding terminal electrode 84 is provided from the side face of the dielectric block 83 to the mounting face (the face opposing to the circuit board on which the antenna is mounted, i.e., back face) so as to be connected to the drawn wiring film 834.

Therefore, the case is likely to occur where radio wave received and transmitted by the radiation element 81 is directly picked up by the feeding terminal electrode 84 on the side face of the dielectric block. Further, an antenna is recently configured to be capable of receiving and transmitting a signal of two or more frequency bands by a cellular phone, i.e., an antenna is recently configured to not only receive and transmit a signal for cellular but also receive a signal of GPS (Global Positioning System) or to be used for Blue-tooth antenna for wireless LAN by a cellular phone. Therefore, signals of two or more frequency bands are likely to be fed to the feeding terminal electrode 84.

On the other hand, formed on the circuit board 86 having the antenna with built-in filter 85 mounted thereon are electronic circuits such as a receiving circuit or transmitting circuit connected to the feeder 862, in which a low noise amplifier not shown is included on the receiving side. In the case where reception and transmission are performed in two or more frequency bands, these electronic circuits are formed for each frequency band. The feeding terminal electrode and these electronic circuits are electromagnetically coupled, with the result that the noise or a signal of the other frequency band picked up by the feeding terminal electrode interferes directly with the circuits on the circuit board, thereby entailing a problem of deteriorating (increasing noise) isolation property (meaning that the coupling between each other is small) or reducing transmit-receive characteristic.

The present invention is accomplished to solve the aforementioned problem, and aims to provide an antenna with built-in filter that is designed to downsize by integrating a filter, made by laminating dielectric sheets, and a radiation element, wherein a mutual interference is not caused between an electronic circuit on a circuit board and a feeding terminal electrode of the antenna even if the antenna is directly mounted on the circuit board, thereby being capable of enhancing isolation property and improving transmit-receive characteristic.

Another object of the present invention is to provide a mounting structure of an antenna with built-in filter mounted on a circuit board so as to be suitable for preventing a mutual interference between the antenna and an electronic circuit, when this antenna with built-in filter is mounted on the circuit board.

DISCLOSURE OF THE INVENTION

An antenna with built-in filter according to the present invention includes: a laminated dielectric block that is formed such that dielectric sheets each having a conductive film formed on one surface are laminated so as to constitute at least one filter; a radiation element fixedly provided at the laminated dielectric block and electrically connected to one electrode of the filter; and a feeding terminal electrode electrically connected to the other electrode of the filter and provided at the outer face of the laminated dielectric block, wherein the feeding terminal electrode is provided on a mounting face that is a face opposing to a circuit board when the laminated dielectric block is mounted on the circuit board and a connecting wiring for connecting the other electrode of the filter and the feeding terminal electrode is not exposed to the outer face other than the mounting face of the laminated dielectric block.

The "radiation element" means here the one that can radiate radio wave such as a radiation electrode wherein a radiation pattern is formed, or a plane radiation electrode pattern which are formed on a face of the dielectric block with a conductive film. Moreover, the phrase "electrically connected" includes not only a direct connection with a conductor but also a connection via other electronic device or electromagnetic coupling even though there is no direct connection with a conductor. Further, the "outer face" means a face exposed to an outside of the laminated dielectric block, and the "mounting face" means a face opposing to a circuit board on which the laminated dielectric block is mounted.

According to this construction, the feeding terminal electrode faces only to a circuit board on which the antenna with built-in filter is mounted and a multi-layer laminate structure in which a shielding plate is embedded can be used for the circuit board, whereby the feeding terminal electrode can be connected to a feeder of the circuit board as it is perfectly shielded. Consequently, external noise is not directly carried on the feeding terminal electrode, and even if a signal of other frequency band appears on the feeding terminal electrode, it is not coupled to a receiving circuit of different frequency band. As a result, isolation property between the feeding terminal electrode and the electronic circuit on the circuit board is extremely enhanced, and further, there is no fear of reducing characteristic of a desired transmitting or receiving signal, thereby obtaining an extremely high-performance antenna with built-in filter.

The electrical connection between the other electrode of the filter and the feeding terminal electrode is performed through a via-contact made of a conductor embedded into a contact hole provided on a dielectric sheet.

The mounting structure of the antenna with built-in filter according to the present invention comprises; the antenna with built-in filter of claim 1 and a circuit board having a laminated structure including at least a shielding layer and a wiring layer, on which the antenna is mounted, wherein the feeding terminal electrode is electrically connected to an internal wiring provided in the circuit board and an electronic device provided on a surface of the circuit board is electrically connected to the feeding terminal electrode via the internal wiring. This structure makes it possible to use the internal wiring for a feeder that is electrically connected to the feeding terminal electrode. Therefore, the feeding terminal electrode can be connected to a component constituting the electronic circuit with a state that it is not at all exposed to the outside and it is shielded by a shielding plate, thereby being capable of providing a transmitter or a receiver with extremely high performance.

BEST MODE FOR CARRYING OUT THE INVENTION

Figure 1A:
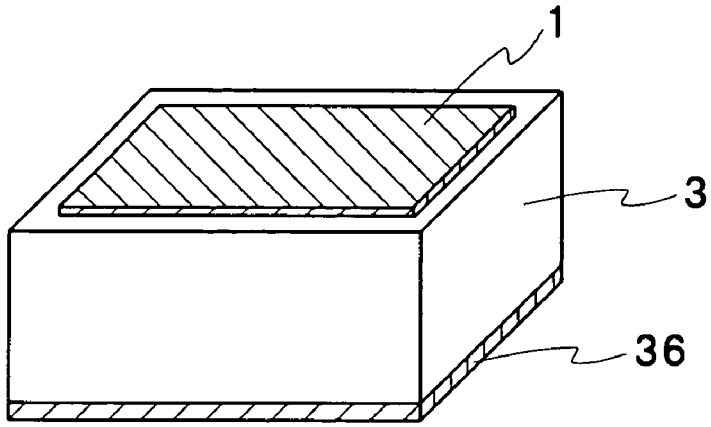
FIGS. 1A to 1C are explanatory views showing one embodiment of an antenna with built-in filter according to the present invention.
Figure 1B:
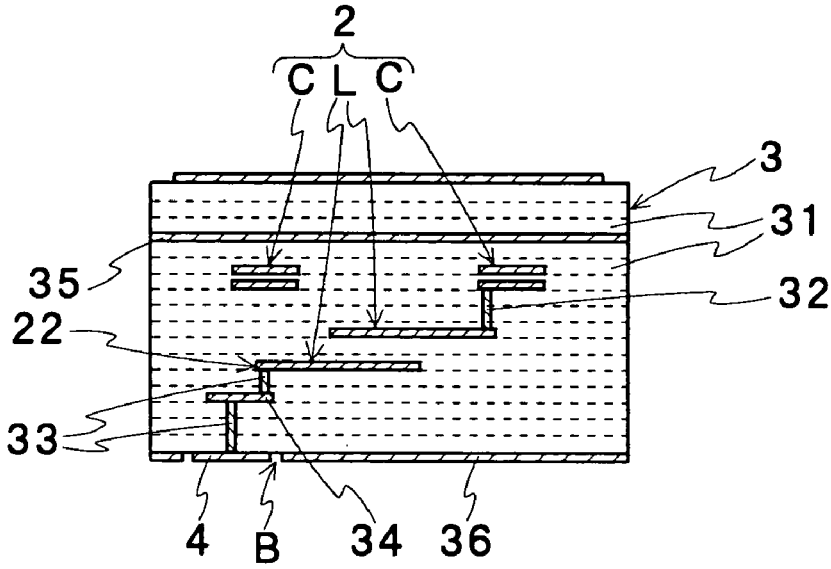
Figure 1C:
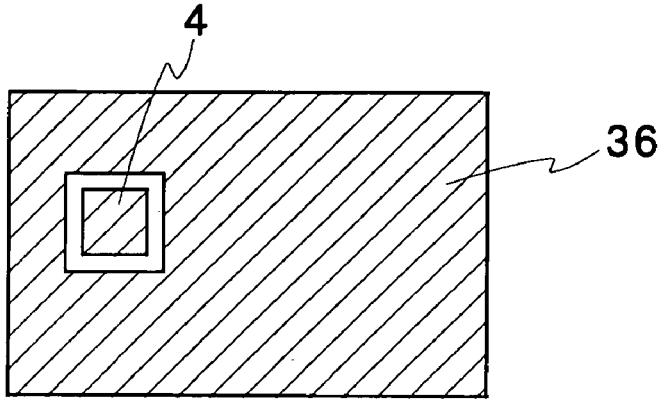

Subsequently, an antenna with built-in filter according to the present invention will be explained with reference to drawings. As FIGS. 1A to 1C show a constructional explanatory view according to one embodiment, the antenna with built-in filter of the present invention has a laminated dielectric block 3 wherein dielectric sheets 31 each having a conductive film formed on its one surface are laminated so as to constitute at least one filter 2. A radiation element 1 is provided so as to fix to the laminating dielectric block 3, wherein one electrode not shown of the filter 2 is electrically connected to the radiation element 1. Further, the other electrode 22 of the filter 2 is connected to a feeding terminal electrode 4 provided at the outer face of the laminated dielectric block 3 through a via-contact 33 and a wiring 34. The present invention is characterized in that, as shown by a back side view of FIG. 1C, the feeding terminal electrode 4 is provided only on a mounting face B that is a face opposing to a circuit board not shown when the laminated dielectric block 3 is mounted on the circuit board, not being exposed to the side face of the laminated dielectric block 3 that is exposed to the outside.

Although the example shown in FIG. 1 illustrates only one radiation element 1 and one filter 2 corresponding to a signal of one frequency band, plural radiation elements 1 (there may be a case where one radiation element can be used for plural frequency bands) or filters 2 for plural frequency bands may be mounted to or installed in one laminated dielectric block 3 in order to make it possible to receive or transmit signals of plural frequency bands such as AMPS/PCS for a cellular phone, global positioning system (GPS) or Bluetooth (BT). In the case where filters for two or more frequency bands are installed into one laminated dielectric block 3, vertical shielding walls are preferably formed in the laminated dielectric block 3 for every block of filter 2 for respective frequency band in order that they are not interfered with each other. The shielding wall can be formed by the same method as that of a band-shaped via-contact described later.

Although the example shown in FIG. 1 illustrates that the radiation element 1 is formed in a patch-like radiation electrode provided on a grounding conductor 35 via the dielectric layer, other configuration may be possible such as a ceramic antenna wherein band-like conductor or the radiation electrode that is patterned by the band-like conductor is capacitively coupled to the feeding electrode, or such configuration is possible in which the radiation element 1 is provided at the side face of the dielectric block 3.

Figure 2A:
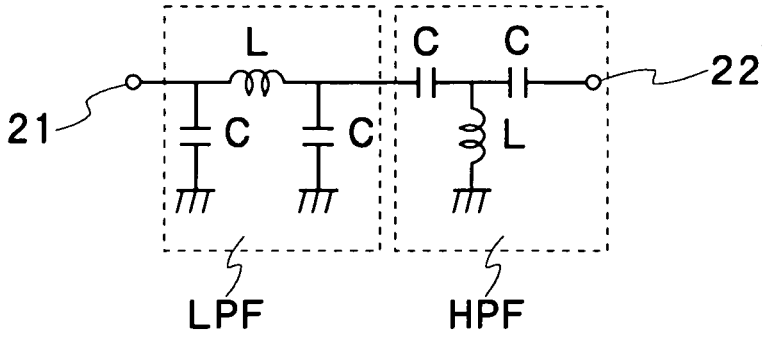
FIGS. 2A and 2B are views showing a constructional example of a filter in a laminated dielectric block shown in FIG. 1.
Figure 2B:
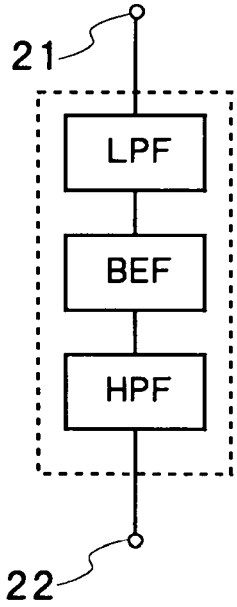

An inductor L, capacitor C and resonator are formed in the laminated dielectric block 3 as described later and they are connected as shown in FIG. 2A to form a single filter or a filter group that is a combination of at least two of a low-pass filter, a high-pass filter, a band pass filter BPF with the resonator and a band-elimination filter, whereby the filter can be configured to pass only a desired frequency band. One electrode 21 of the filter 2 is electrically connected to the radiation element 1, while the other electrode 22 is electrically connected to the feeding terminal electrode 4. Further, in the case where radiation elements and filters for two or more frequency bands are installed for, for example, a cellular phone of AMPS (0.8 GHz)/PCS (1.8 GHz) and for GPS (1.5 GHz), the filter connected to the antenna for GPS has connected thereto a high-pass filter HPF for cutting a frequency band lower than 1.4 GHz and a low-pass filter LPF for cutting a frequency band higher than 1.6 GHz and has inserted therein a band-elimination filter BEF of 1.8 GHz for surely cutting 1.8 GHz-band close to 1.5 GHz, as shown in FIG. 2B, thereby being capable of surely preventing the other signal from being interfered. It can be formed by only changing the size or connection of L and C for the other frequency band.

The laminated dielectric block 3 has ceramic sheets (green sheets) 31 each having a conductive film formed on one face in a desired pattern by a printing as shown by a sectional explanatory view in FIG. 1B, wherein a conductive film is formed in a desired pattern on each dielectric sheet 31 such that a strip line that constitutes an inductor L, and a capacitor C which is formed by forming the conductive film with the dielectric sheet 31 sandwiched therebetween are formed respectively, and wherein via-contact 32 for connecting the inductor Land the capacitor C, and a via-contact 33 and wiring 34 for connecting the other electrode 22 of the filter 2 described later to the feeding terminal electrode 4 are formed. The laminated dielectric block 3 also may have a conductive film 35 formed on its entire face for shielding. The ceramic sheets 31 are superposed and pressed, whereupon the resultant is cut and sintered to form the laminated dielectric block 3 having an outer size of approximately (2 to 30 mm)×(2 to 30 mm) and a thickness of approximately 0.5 to 7 mm, for example.

The via-contact 33 and the wiring 34 for connecting the other electrode 22 of the filter 2 to the feeding terminal electrode 4 are formed in order that the other electrode 22 is directly drawn to the bottom surface (mounting face B) of the laminated dielectric block 3 through the inside of the laminated dielectric block 3, that means the other electrode 22 is not drawn to the bottom surface through the side face of the laminated dielectric block 3. The example shown in FIG. 1 illustrates that two via-contacts 33 are connected via the wiring 34. The reason of this is as follows. Specifically, a first reason is in the case where the electrode 22 of the filter and the feeding terminal electrode 4 are deviated from the viewpoint of plane. And a second reason is in the case where the distance between the electrode 22 and the bottom face of the dielectric block 2 is great, because the positions where the via-contacts are formed become thick if via-contacts are formed at the same positions of many dielectric sheets. Therefore, two or more via-contacts 33 are formed for shifting each position of the via-contacts in the case where the via-contacts 33 are required to be shifted at a different position from the viewpoint of plane. However, if there is no such need, a single via-contact 33 can connect the other electrode 22 of the filter 2 and the feeding terminal electrode 4 directly.

Figure 3:
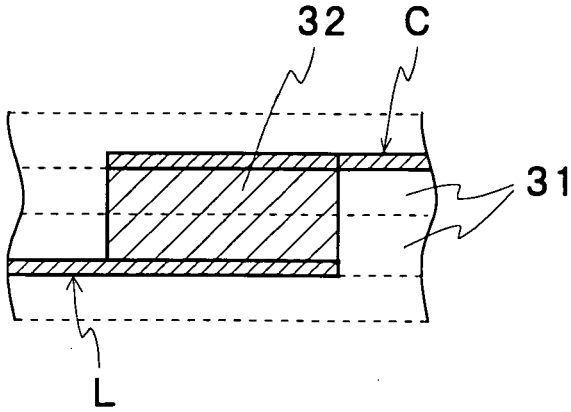
FIG. 3 is a view showing a constructional example of a via-contact shown in FIG. 1.

The upper and lower conductive films between which the ceramic sheet 31 is sandwiched are connected by the via-contacts 32 and 33 that establish a connection by embedding the conductor into a contact hole (though-hole) formed in the ceramic sheet 31. As shown in FIG. 3 by a vertical sectional explanatory view of the via-contact section 32 shown in FIG. 1B, the via-contacts 32 and 33 are formed into a band-like (band-form) shape. This increases the cross sectional area of the connection to prevent the increase in high-frequency resistance and inductance, whereby a high-performance filter can be formed although the filter has a laminated structure. The band-like via-contacts 32 and 33 can be formed by forming the contact hole provided at the ceramic sheet 31 into a long and thin (slender) groove.

The laminated dielectric block 3 having the above-mentioned configuration is manufactured as follows. A contact hole or slender groove for the via-contact is formed by a forming die on a ceramic sheet 31 having a thickness of about 100 μm, and then, conductor in the groove (via-contact) and required strip line are formed by a printing of a conductive paste. Thereafter, several tens of the ceramic sheets are superposed and pressed to be hardened in order that the filter circuit or via-contacts 32 and 33 are formed as described above, and sintered after cutting into a size of each laminated dielectric block or ditching for cutting, thereby obtaining a laminated dielectric block. A conductor such as a silver paste is provided by a printing on its side face, whereby the radiation element 1 or grounding conductor 36 can be formed at the front face, side face or bottom face of the laminated dielectric block 3.

The feeding terminal electrode 4 is formed by the same manner as forming the aforementioned radiation element 1 and the grounding conductor 36, wherein a conductive material such as a silver paste is formed by a printing so as to connect to the via-contact 33, and the resultant is sintered.

Figure 4:
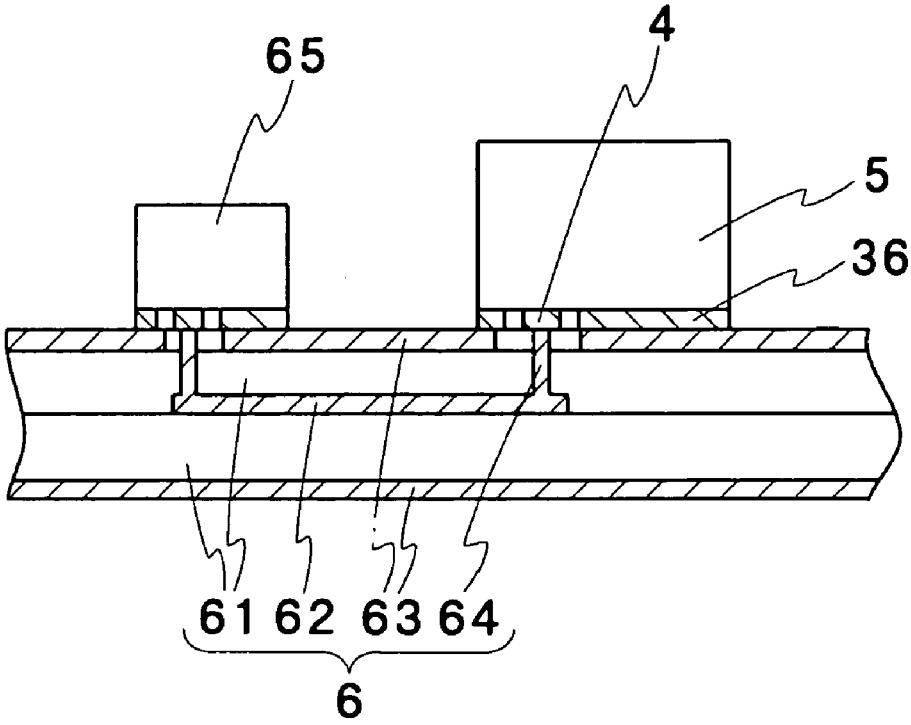
FIG. 4 is a sectional explanatory view of an example for mounting the antenna with built-in filter shown in FIG. 1 to a circuit board.

The antenna with built-in filter as described above is directly mounted to a circuit board on which a signal processing circuit is formed and incorporated into a housing of a cellular phone or the like. The antenna with built-in filter 5 having a configuration such that the feeding terminal electrode 4 of the present invention is not exposed to the side face of the laminated dielectric block 3 can connect the feeding terminal electrode 4 and a low noise amplifier 65 of a receiving signal processing circuit, for example, with a perfect shielding state by using the circuit board 6 having a laminated structure wherein at least one wiring layer such as a shielding layer 63 and feeder 62 is formed on an insulating sheet 61 as shown in FIG. 4 (although in the example shown in FIG. 4, the shielding layer 63 is formed on the upper and lower outer faces, only one shielding layer may be formed or it may be formed inside). Therefore, the coupling between the feeding terminal electrode 4 and the electronic circuit can almost perfectly be eliminated.

Figure 7A:
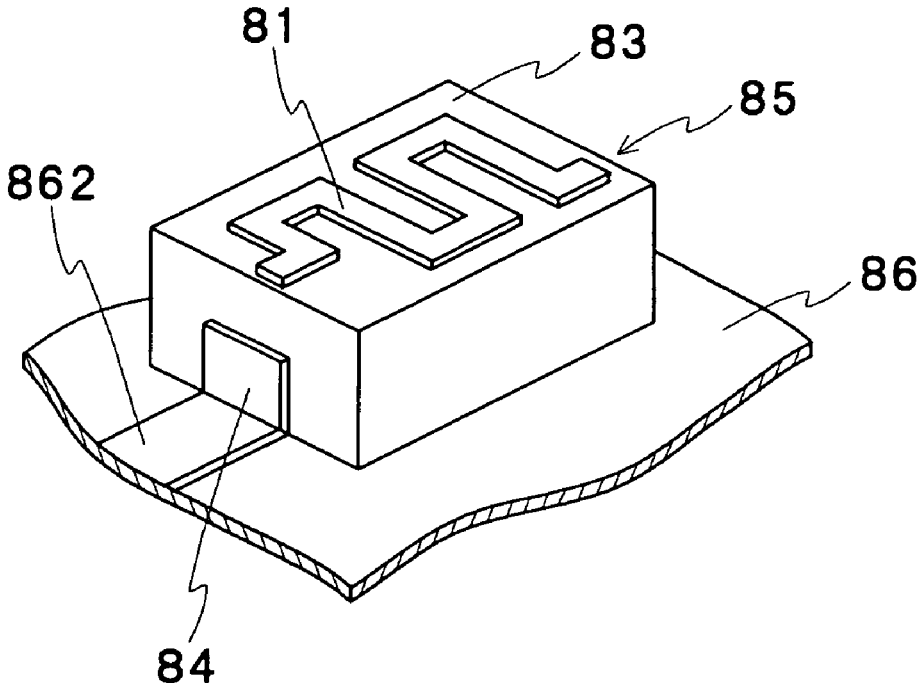
FIG. 7A PRIOR ART
FIGS. 7A and 7B are explanatory views of a state where a conventional antenna with built-in filter is mounted to a circuit board.
Figure 7B:
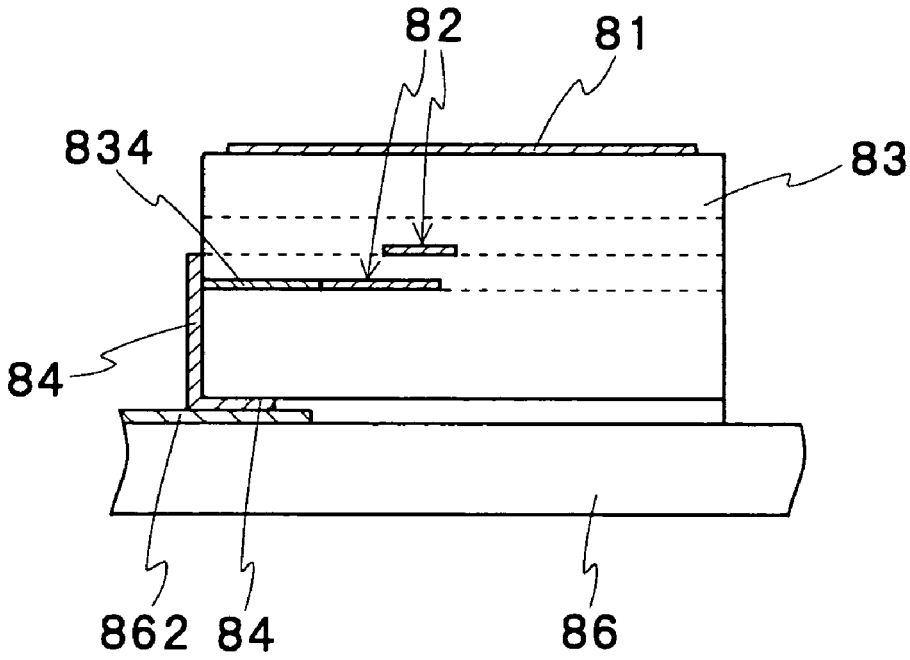
FIG. 7B PRIOR ART

Even if the feeding terminal electrode is directly connected to the feeder on the surface of the circuit board that is a conventional mounting structure shown in FIG. 7, the mutual coupling between the feeding terminal electrode and the electronic circuit on the circuit board is extremely restrained, since the feeding terminal electrode is completely positioned only at the back side of the laminated dielectric block, thereby enhancing isolation property between the feeding terminal electrode and the electronic circuit on the circuit board.

Figure 5:
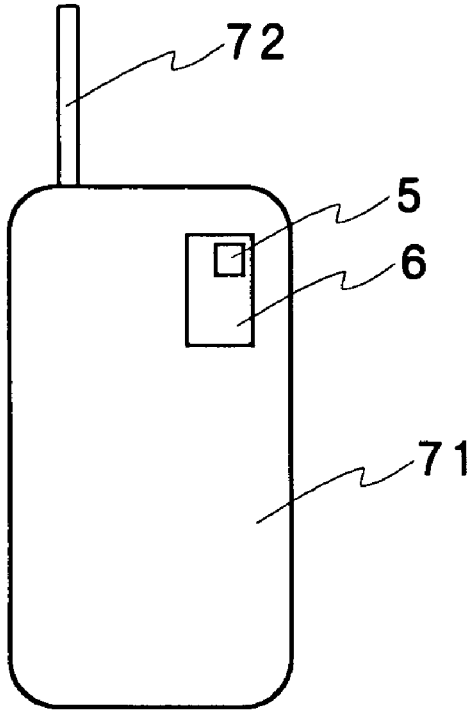
FIG. 5 is a view showing an outline of a device testing a performance of FIGS. 6A and 6B.
Figure 6A:
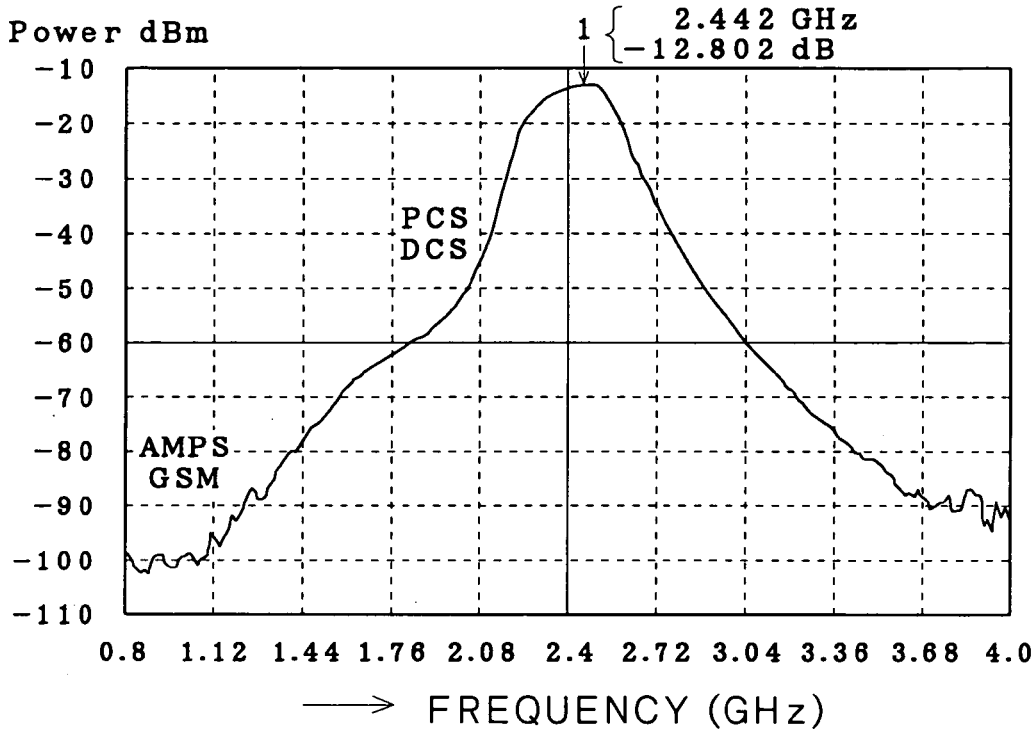
FIG. 6A is a frequency characteristic view of antenna gain according to the present invention.

The antenna with built-in filter according to the present invention is connected to a feeder provided on a surface of a circuit board to check frequency characteristic of the antenna, that is a gain relationship to a frequency, by comparing it to a conventional antenna with built-in filter having a structure wherein a feeding terminal electrode is provided on a surface of a side wall of the laminated dielectric block. This characteristic test was made as follows. Specifically, as shown in FIG. 5, an antenna 72 for a test was installed to a housing 71 such as, for example, a cellular phone. The circuit board 6 having the antenna with built-in filter 5 mounted thereto was attached in the housing 71. A gain-frequency characteristic by a receiving signal was tested when the antenna 72 for a test radiates signals having each frequency of 0.8 to 4 GHz. It should be noted that Bluetooth antenna for 2.4 GHz band was used for the antenna with built-in filter 5. FIG. 6A shows a characteristic of the structure in which the antenna according to the present invention is directly connected to the feeder provided on the surface of the circuit board, while FIG. 6B shows a characteristic of the structure in which the feeding terminal electrode is also provided on the side face as shown in FIG. 7.

Figure 6B:
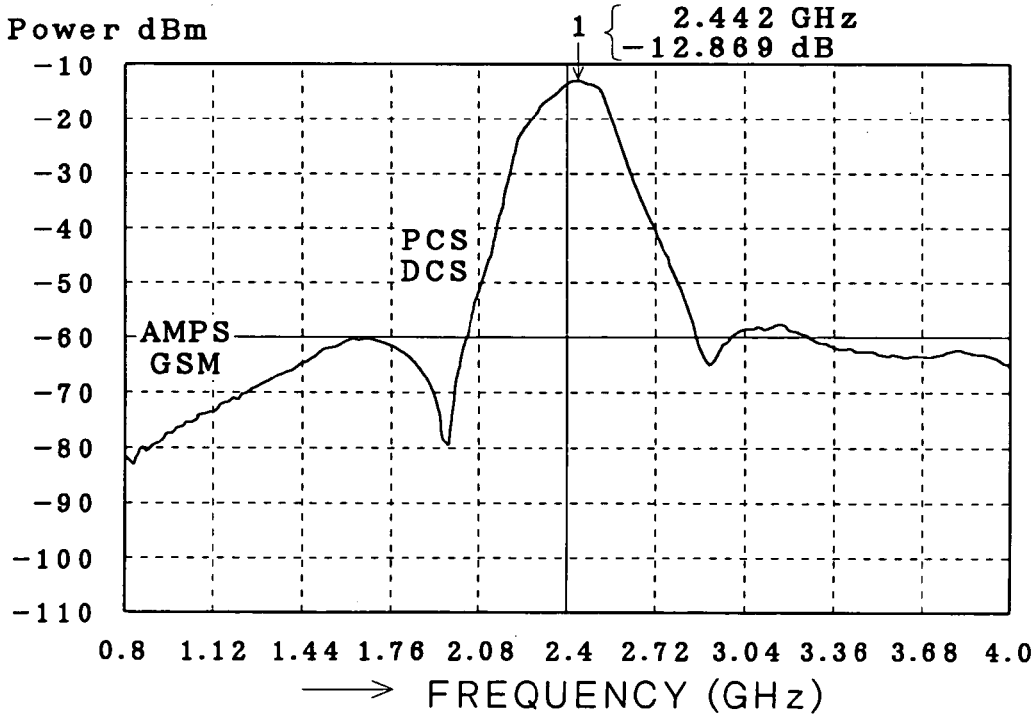
FIG. 6B is a frequency characteristic view of antenna gain according to a conventional structure.

As apparent from FIGS. 6A and 6B, a great attenuation is made in a frequency band of not more than 1.76 GHz and not less than 3.04 GHz according to the present invention (it is preferable to attenuate in a frequency band other than a desired 2.4 GHz band), while attenuation is very small even in a separate frequency band according to the conventional structure of FIG. 6B, that means external noise is prone to be picked up. In the present invention, the filter is incorporated so as to attenuate a signal of a frequency band other than 2.4 GHz band. Therefore, attenuation is made in the frequency band separate from 2.4 GHz due to the operation of the filter in the present invention. However, there is radio wave directly picked up by the feeding terminal electrode in the conventional structure, and it is considered that this radio wave is prone to be picked up as noise, since this radio wave cannot be eliminated because it does not pass the filter. Specifically, it is indicated that the structure having the feeding terminal electrode exposed to the outside is greatly susceptible to the external noise and that mutual interaction is likely to occur between the feeding terminal electrode and the receiving circuit. This tendency is not limited to the Bluetooth antenna, but the same result can be obtained by a GPS antenna or cellular antenna.

According to the present invention, the feeding terminal electrode of the antenna with built-in filter is provided only on the mounting surface that opposes to the circuit board on which the antenna with built-in filter is to be mounted, not provided at the side wall that is exposed to the outside. On the other hand, conductive films are suitably provided in a wide range in the laminated dielectric block to function as a shielding plate, and the grounding conductor can be provided also around the feeding terminal electrode. Further, the function of a shielding plate can also be given to the circuit board. Therefore, interference with the outside can surely be restrained. Consequently, there is no chance that the receiving signal directly enters the feeding terminal electrode without passing through the filter, and further, there is no chance that the feeding terminal electrode and the electronic circuit on the circuit board are electromagnetically coupled to cause interaction. As a result, the isolation property is extremely enhanced (that means the degree of coupling is small between the feeding terminal electrode and the neighboring electronic circuit) and the influence by the external noise is greatly restrained, thereby being capable of enhancing antenna performance.

Further, according to the present invention, the feeding terminal electrode is not provided at the side face of the laminated dielectric block 3, so that the electronic circuit formed on the circuit board and the antenna with built-in filter can be arranged so as to close to each other, which contributes to downsize the circuit board. Moreover, using the circuit board of a laminate structure having a wiring therein enables an electrical connection with a perfect shielding state between the feeding terminal electrode and the components of the electronic circuit, thereby being capable of further enhancing the isolation property. Further, there arises an effect of increasing a degree of freedom in the arrangement of the components on the circuit board without causing any trouble due to the perfect shielding function, even if it is connected to a remote electronic component.

According to the present invention, the feeding terminal electrode of the antenna with built-in filter wherein the antenna and the filter are integrated is formed such that it is difficult to interfere with the outside, thereby being capable of remarkably restraining the interaction between the feeding terminal electrode and the circuit board on which the antenna with built-in filter is mounted. Therefore, the antenna with built-in filter having remarkably enhanced transmitting or receiving characteristic can be obtained. Moreover, the antenna with built-in filter and the electronic circuit on the circuit board can be arranged so as to close to each other, in addition to the integration of the filter and the antenna, thereby contributing to the miniaturization even when miniaturization is particularly demanded for a portable device such as a cellular phone.

Moreover, in the case where the antenna with built-in filter according to the present invention is used, the substrate of the laminated structure is used for the circuit board and it is connected to the electronic circuit via the shielded internal wiring, thereby being capable of further enhancing isolation property.

INDUSTRIAL APPLICABILITY

According to the present invention, the feeding terminal electrode can be connected to a feeder of the circuit board as it is perfectly shielded. Consequently, external noise is not directly carried on the feeding terminal electrode, and even if a signal of other frequency band appears on the feeding terminal electrode, it is not coupled to a receiving circuit of different frequency band. As a result, it can be utilized as a compact, high-performance antenna for cellular, GPS or Bluetooth suitable to be mounted to a cellular phone or portable terminal device that is used in plural frequency bands.

What is claimed is:

1. An antenna with built-in filter comprising:

a laminated dielectric block that is formed such that dielectric sheets each having a conductive film formed on one surface are laminated so as to constitute at least one filter;

a radiation element fixedly provided at the laminated dielectric block and electrically connected to one electrode of the filter; and a feeding terminal electrode that is provided on a mounting face of the dielectric block, and opposes to a circuit board when the laminated dielectric block is mounted on the circuit board;

wherein the feeding terminal electrode and the other electrode of the filter are electrically connected by at least one connecting wiring provided on one of one or more dielectric sheets, and two or more via-contacts each of which is composed of a conductor embedded into a contact hole formed in at least one of the one or more dielectric sheets, wherein the at least one connecting wiring and the two or more via-contacts are not exposed to an outer face of the laminated dielectric block, and wherein the two via-contacts are formed at places that are different from each other on a plane view of the dielectric block.

2. The antenna with built-in filter of claim 1, wherein at least one of the via-contacts is formed into a band shape by embedding the conductor into a slender and groove-like contact hole provided on the at least one of the one or more dielectric sheets so as to increase the cross section of the via-contact.

3. The antenna with built-in filter of claim 1, wherein the filter comprises a filter group including at least two of a low-pass filter, a high-pass filter and a band elimination filter.

4. A mounting structure of an antenna with built-in filter comprising:

the antenna with built-in filter of claim 1; and a circuit board which has a laminated structure including at least a shielding layer and a wiring layer, on which the antenna is mounted, wherein the feeding terminal electrode is electrically connected to an internal wiring provided in the circuit board and an electronic device provided on a surface of the circuit board is electrically connected to the feeding terminal electrode via the internal wiring.

5. The antenna with built-in filter of claim 1, wherein the radiation element is formed so as to be capable of receiving or transmitting two or more frequency bands, and two or more filters are formed so as to be capable of receiving or transmitting signals of the two or more frequency bands.

6. The antenna with built-in filter of claim 5, wherein one of the two or more filters comprises a band elimination filter for eliminating a frequency band of a signal that is received or transmitted by the other filter of the two or more filters.

7. The antenna with built-in filter of claim 5, wherein the two or more frequency bands received or transmitted by the radiation element comprise at least two of frequency bands for cellular, a frequency band for GPS and a frequency band for Bluetooth.

8. The antenna with built-in filter of claim 5, wherein two or more filters are shielded not so as to interfere with each other by forming a shielding wall in a vertical direction in dielectric sheets of the laminated dielectric block, the shielding wall being formed by a band-like via-contact provided in the dielectric sheets.

9. An antenna comprising:

a dielectric filter block having first and second filter electrodes therein;

a radiation element provided on the dielectric filter block and electrically connected to the first filter electrode of the dielectric filter block;

a feeding terminal electrode provided on a mounting face of the dielectric filter block that faces a circuit board when the dielectric filter block is mounted on the circuit board;

at least one connecting wiring that is provided in the dielectric filter block and extends in a first direction approximately parallel to the mounting face of the dielectric filter block;

two or more via-contacts, each of which is composed of a conductor embedded into a contact hole formed in the dielectric filter block and extends in a second direction which is different from the first direction, and in which the two or more via-contacts are electrically connected through the at least one connecting wiring;

wherein the feeding terminal electrode and the second electrode of the dielectric filter block are electrically connected by the two or more via-contacts and the at least one connecting wiring; and wherein the two via-contacts are formed at different places from each other in a plane view of the dielectric filter block.

10. The antenna according to claim 9, wherein the dielectric filter block includes a conductive film.

11. The antenna according to claim 9, wherein the dielectric filter block includes two or more dielectric sheet.

* * * * *